US005507861A

United States Patent [19]

Caupin et al.

[11] Patent Number: 5,507,861

[45] Date of Patent: Apr. 16, 1996

[54] CARBOXYLIC ACID-BASED CORROSION-INHIBITING COMPOSITION AND APPLICATION THEREOF IN CORROSION PREVENTION

[75] Inventors: Henri-Jean Caupin, Versailles; Harry Seidl, Jarnac; Pierre Steinmetz, Vandoeuvre, all of France

[73] Assignee: Elf Atochem S.A. and Haber Partners Sarl, France

[21] Appl. No.: 16,912

[22] Filed: Feb. 12, 1993

[30] Foreign Application Priority Data

| | | | |
|---|---|---|---|
| Feb. 14, 1992 | [FR] | France | 92 01698 |
| Nov. 26, 1992 | [FR] | France | 92 14233 |

[51] Int. Cl.[6] ..... C09D 5/00; C23F 11/08

[52] U.S. Cl. ..... 106/14.13; 106/14.05; 106/14.14; 106/14.44; 252/388; 252/389.1; 252/389.4; 252/389.62

[58] Field of Search ..... 106/14.13, 14.14, 106/14.44, 14.05; 252/388, 389.1, 389.62, 389.4

[56] References Cited

U.S. PATENT DOCUMENTS

| | | | |
|---|---|---|---|
| 3,573,225 | 3/1971 | Kondo . | |
| 4,246,030 | 1/1981 | Lipinski | 106/14.14 |
| 4,406,811 | 9/1983 | Christensen et al. | 106/14.13 |
| 4,687,634 | 8/1987 | Baseman et al. | 106/14.29 |

FOREIGN PATENT DOCUMENTS

| | | | |
|---|---|---|---|
| 0099598 | 2/1984 | European Pat. Off. . | |
| 0229440 | 7/1987 | European Pat. Off. . | |
| 0251480 | 1/1988 | European Pat. Off. . | |
| 0308037 | 3/1989 | European Pat. Off. . | |
| 0479470 | 4/1992 | European Pat. Off. . | |
| 2010155 | 2/1970 | France . | |
| 2257703 | 8/1975 | France . | |
| 2275568 | 1/1976 | France . | |
| 2346465 | 10/1977 | France . | |
| 60-127378 | 7/1985 | Japan | 106/14.41 |
| 0201029 | 1/1992 | WIPO . | |

OTHER PUBLICATIONS

Hersch et al., "An Experimental Survey of Rust Preventives in Water II The Screening of Organic Inhibitors", Journal of Applied Chemistry, vol. 11, Jul. 1, 1961, London GB pp. 246–265.

Fujita et al., "Corrosion Prevention by Nonanoic Acid Salts", Chemical Abstracts, vol. 114, No. 22, p. 307, June 3, 1991, Columbus, Ohio, US/Abstract No. 21209ic.

Tan et al., "Organic Corrosion Inhibitors for Mild Steel in Aerated Near–Neutral Chloride Solutions," Werkstoffe Und Korrosion, vol. 42, No. 9, p. R197, Sep. 1991/Abstract.

*Primary Examiner*—Anthony Green

*Attorney, Agent, or Firm*—Pennie & Edmonds

[57] ABSTRACT

There is provided a corrosion inhibiting composition comprising carboxylic acids or derivatives thereof wherein said acids are monocarboxylic acids containing an odd number of carbon atoms, and the application thereof to the prevention of corrosion.

17 Claims, No Drawings

CARBOXYLIC ACID-BASED CORROSION-INHIBITING COMPOSITION AND APPLICATION THEREOF IN CORROSION PREVENTION

BACKGROUND OF THE INVENTION

The present invention relates to a carboxylic acid-based composition for inhibition of corrosion, as well as the application of said composition to inhibiting corrosion both of ferrous and non-ferrous metals.

It is known that in numerous uses, notably and by way of example which should not be considered as limiting, in refrigeration systems using circulating water employing anti-freeze agents, and, among other things, in automobile cooling circuits, carboxylic and dicarboxylic acids and salts thereof are very widely used as corrosion inhibiting agents. Additionally, these acids are employed as atmospheric corrosion inhibitors and, for this purpose, are applied as a coating on materials needing protection. Carboxylic acid derivatives, soluble in lipids, are also employed for protection of the so-called "greasy" type, for example for protecting mechanical parts of engines.

Thus, among other documents, U.S. Pat. No. 4,561,990 which is included herein by reference, describes the use of dicarboxylic acid for this purpose. Similarly, U.S. Pat. No. 4,851,145 describes the use of alkylbenzoic acid for this purpose, or of one of the salts thereof, U.S. Pat. No. 4,588,513 describes the use of dicarboxylic acids or salts thereof. At present, the most frequently used dicarboxylic acid is the C12 acid, which however is expensive.

U.S. Pat. No. 4,687,634 discloses corrosion inhibiting compositions comprising: (1) a major amount of an oleaginous carrier and a minor amount (2) of a hydrophylic co-solvent soluble in oil and (3) a $C_7$ organic acid and dicyclohexylamine salt. Protection is also of the "greasy" type.

EP-0 251 480 discloses ternary compositions comprising a triazole derivative which there is currently an attempt to eliminate because of environmental protection rules.

S. H. Tan et al. CASS 90: Corrosion-Air, Sea, Soil [Proc. Conf.] Auckland, NZ, 19–23, November 1990 discloses tests relating to the inhibiting ability of various organic constituents including the family of $C_6$ to $C_{10}$ monocarboxylic acids and $C_7$ to C12 dicarboxylic acids.

FR-A-2 257 703 discloses compositions comprising acids of the $C_5$ to $C_9$ acid family. Nevertheless, these patents do not provide a solution to all the problems involved in the use of anti-corrosion agents. Firstly, considering environmental protection rules which are becoming increasingly strict, anti-corrosion additives need to be biodegradable. When considering anti-corrosion action in hard water, in other words with a high limestone content, it is often necessary to add calcium complexing agents in order to avoid the anti-corrosion additive from precipitating out. Adding the complexing agent makes the composition more complex. Frequently, protection of ferrous and non-ferrous metals involve differing measures, and formulations that contain agents of varying types are then required. Current anti-corrosion formulations are complex compositions which differ as a function of the uses for which they are intended.

Work which lead to the present invention showed, in a quite unexpectedly manner, and in any case surprisingly, that in this corrosion-inhibiting application, certain known carboxylic acids give rise to a distinctly improved and unexpected inhibiting action in applications in which such mixtures are generally employed, allowing the above-mentioned disadvantages to be obviated.

SUMMARY OF THE INVENTION

The invention thus provides a corrosion inhibiting composition comprising carboxylic acids or derivatives thereof wherein said acids are monocarboxylic acids containing an odd number of carbon atoms.

Below, we shall refer to the monocarboxylic acid containing an odd number of carbon atoms as a "odd-numbered carboxylic acid" or "odd-numbered acid". Preferably, said acids are selected from the group consisting of heptanoic acid, nonanoic acid and undecanoic acid. Heptanoic acid and derivatives thereof, and undecanoic acid and derivatives thereof are particularly preferred.

In one preferred embodiment, the odd-numbered carboxylic acid or derivative is in the form of a water-soluble derivative.

According to one variant of the above embodiment, the water-soluble form of the odd-numbered carboxylic acid consists of the salt of an alkaline or alkaline-earth metal which can advantageously be sodium.

According to another preferred embodiment, the said acids can be present in lipid-soluble form.

The invention also relates to the application of the above compound to inhibition of corrosion, and, among other applications, to the inhibition of corrosion in cooling circuits, notably automobile cooling circuits.

The present invention is in fact based on the surprising and unexpected finding that the odd-numbered acid or salts thereof gives rise to an improved corrosion-inhibiting action.

The invention not only covers this unexpected application of the odd-numbered acid but also all compositions in which, by way of an additive, the odd-numbered acid or one of the salts thereof has been added in a pure or close-to-pure state, as well as to compositions that essentially consist of odd-numbered acid.

Actually, a derivative such as sodium heptanoate gives excellent results as will be demonstrated below, where comparative tests in relation with neighboring fatty acids, alone or with other anti-corrosive combinations, were carried out. Similar tests can be done on other water-soluble derivatives of the same heptanoic acid (C7), in particular salts of alkaline and alkaline-earth metals and salts of hydroxylamine, for example ethanolamine, or with lipid-soluble derivatives such as, for example, non-hydroxylated amine salts, such as ethylamine or diethylamine.

The present invention also covers all corrosion-inhibiting compositions based on carboxylic acids or derivarives thereof, the odd-numbered carbon atom acid or derivatives thereof representing at least 20%, advantageously 50%, by weight, calculated on the basis of the acid form, of said carboxylic acids.

The invention also relates to an aqueous composition comprising 0.1 to 10% by weight, based on the weight of said aqueous composition, of the corrosion inhibiting composition.

In one embodiment, the composition according to the invention also includes an oxidizing agent, advantageously a perborate. Preferably, the composition has a pH of about 8.

Practical availability of pure $C_7$ and $C_{11}$ cuts is possible from ricin oil cracking. It is also possible through the addition of CO to a $C_6$ or $C_{10}$ alphaolefin. Additionally, cracking cuts from oleic acid cuts through ozonolysis yield a co-product consisting in $C_9$ acids, both mono- and di-acids, a mixed cut of $C_7$ average molecular weight with about 30 to 40% by weight of $C_7$ acid. All these cuts can be employed as an odd-numbered acid for their anti-corrosive effectiveness.

The anti-corrosive formulae disclosed here have the merit of being simple to control, to provide and to implement. The same does not apply to numerous complex formulations where the use of certain components is necessary in order to eliminate the disadvantages of certain active substances present.

Other aims and advantages of the present invention will become more clear from the examples that follow and the results of tests that are provided, which should however not be considered as limiting of the invention.

The results listed in the tables were obtained by using the ASTM D-1384 standard for verifying the level of protection of automobile coolants. These tests could obviously have been carried out on systems other than automobile coolant systems and it should hence not be considered that the invention is limited to automobile cooling circuit corrosion protection or, even more generally, to refrigeration circuits employing water or an aqueous solution as the refrigerant.

EXAMPLE 1

Various engine refrigerant solutions (Sr) were prepared according to ASTM D-1384 standard, comprising (by weight):

33.33% of monoethyleneglycol (MEG), inhibited (or not inhibited, in the case of the control), 66.67% of a corrosive water containing:

148 mg/l sodium sulfate 165 mg/l sodium chloride 138 mg/l sodium bicarbonate.

The inhibited MEG mentioned above consisted of MEG containing 1.5% by weight of an inhibiting solution (Si) and 20 g/l of sodium tetraborate.10 $H_2O$.

The Si solution was an aqueous solution containing, expressed in grammes per liter of solution:

250 g of a sodium salt of a monocarboxylic acid having 6, 7, 8 or 10 carbon atoms or of dodecanedioic acid, 15 g sodium benzoate, 3 g tolyltriazole.

In the table below, the loss of weight, expressed in $mg/cm^2$, of various metals brought in contact with solution Sr is given, in accordance with the ASTM D 1384 standard. In this table, the abovementioned sodium salts are referred to by the abbreviated formulae Na $C_6$, Na $C_7$ . . . $Na_2C_{12}$, (the $C_{12}$ acid being a dicarboxylic acid), corresponding to the number of carbon atoms in the acid. MEG refers to the control (pure MEG).

TABLE I

| Sample | $H_2O$ | MEG | $NaC_6$ | $NaC_7$ | $NaC_8$ | $NaC_{10}$ | $Na_2C_{12}$ |
|---|---|---|---|---|---|---|---|
| Steel | 3.210 | 6.831 | 0.928 | 0.013 | 1.310 | 1.025 | 0.085 |
| Copper | 0.981 | 1.903 | 0.009 | 0.001 | 0.002 | 0.011 | 0.009 |
| Brass | 0.908 | 2.400 | 0.012 | 0.003 | 0.003 | 0.013 | 0.013 |
| Solder | 6.807 | 7.200 | 1.800 | 0.096 | 0.910 | 1.200 | 0.110 |
| Cast aluminum | 9.000 | 12.100 | 1.310 | 0.021 | 0.710 | 0.820 | 0.087 |
| Cast iron | 6.902 | 8.500 | 1.310 | 0.008 | 1.420 | 1.141 | 0.098 |
| pH before test | | | 8.2 | 8.5 | 8.6 | 8.3 | 8.5 |
| pH after test | | | 8.00 | 8.5 | 8.6 | 8.3 | 8.5 |
| R.A. before test | | | 11.5 | 11.5 | 11.6 | 11.4 | 11.5 |
| R.A. after test | | | 9.9 | 10.9 | 10.9 | 10.3 | 10.9 |
| Number of tests (average) | 3 | 3 | 5 | 17 | 5 | 5 | 5 |

R.A. stands for Alkalinity Margin.

In the test summarized in table II, Sr solutions having 33.33% inhibited MEG and 66.67% of the corrosive water described above were also used. The inhibited MEG consisted of MEG that included 3% by weight of an $S_2$ inhibiting solution itself comprising an aqueous solution containing 33.33% by weight of the above-mentioned sodium salts.

TABLE II

| Sample | $H_2O$ | MEG | $NaC_6$ | $NaC_7$ | $NaC_8$ | $NaC_{10}$ | $Na_2C_{12}$ |
|---|---|---|---|---|---|---|---|
| Steel | 3.210 | 6.831 | 1.089 | 0.014 | 1.915 | 1.316 | 0.092 |
| Copper | 0.981 | 1.903 | 1.210 | 0.131 | 1.310 | 1.210 | 0.195 |
| Brass | 0.908 | 2.400 | 1.305 | 0.147 | 1.321 | 1.120 | 0.230 |
| Solder | 6.807 | 7.200 | 1.790 | 0.380 | 2.810 | 1.806 | 1.310 |
| Cast aluminum | 9.000 | 12.100 | 1.340 | 0.881 | 1.370 | 0.950 | 0.910 |
| Cast iron | 6.902 | 8.500 | 1.400 | 0.009 | 2.370 | 1.290 | 0.101 |
| Number of tests | 3 | 3 | 3 | 3 | 3 | 3 | 3 |

When the results given in tables I and II are studied, it will be noticed that the heptanoic acid derivative gave, in every case, the best results as regards corrosion inhibition obtained since, in all cases, the results that were obtained are better or at least equal to the results obtained on each one of the other acids comprised between $C_6$ and $C_{12}$ generally found in the carboxylic acid mixtures employed.

Tables I and II of the ASTM D 1384 tests highlight the particular role of the heptanoic acid ($C_7$) derivative compared to neighbouring acids:

in a conventional 3-component formulation including the fatty acid salt, it is observed that the overall effectiveness profile of the $C_7$ derivative is distinctly better than that of its neighbours, and that the $C_{12}$ diacid is the first one able to be compared therewith, in a formulation that only contains the fatty acid salt as a corrosion inhibitor, this being the case for the examples for which the results are given in table II, it will we noticed that the ($C_7$) derivative column is the one that yielded the best results compared to all the others.

The presence of a sodium heptanoate salt, in a concentration of 1% by weight in the ASTM D-1384 water is studied below for the case of copper.

A reduction in corrosion current was observed, and particularly the appearance of a plateau lying between 200 and 950 mV/ECS, with a substantially constant anode current density, the value being of the order of 3 $\mu A/cm^2$. In the absence of heptanoate, the I=f(E) curve for copper showed a continuous increase in anode current beyond the corrosion potential.

Without wanting to be bound by any theory, the applicant believes that the inhibiting action of the sodium heptanoate solution (0.08M; pH=8) can be attributed to the adsorption of $C_7^-$ carboxylate anions on a $Cu(OH)_2$ oxide film.

EXAMPLE 2

Tables III and VII below give the results of tests in which prepared samples of steel were simply dipped into the water at fixed temperatures and for determined durations. Visual observation of modifications to the state of their surface was classified into three appearance classes: good, tarnished, rusted. The tests were completed by determination of the specific loss of weight of each sample after a standardized cleaning procedure carried out by the same operator. This test was part of a fast and inexpensive selection method used for identifying comparative degrees of performance on different products.

Over periods of 48 and 92 hours, at a temperature held at 45° the weight loss results speak for themselves regarding the results for the ($C_7$) heptanoic acid derivative when compared to neighbouring cuts. Without the addition of other components, present in the formula employed in the ASTM D-1384 standard, the $C_7$ derivative even clearly overtakes the $C_{12}$ derivative which up until now was considered as excellent.

The tables given even make it possible to quantify the impact of the chosen degrees of protection as regards loss of weight of each sample from 0.1% additive and 1% in water. For each test, the control tested in "pure water" had its results listed, and the number of tests carried out in each aqueous corrosion configuration is given.

These tests were carried out either over 48 hours or 92 hours depending on the case, and the letters G, R, M meaning Good, Rusted or Reddish and Mat refer to the sample's appearance and the letters C, R and T, indicating Clear, Rusty and Turbid (cloudy) relate to the liquid's appearance.

The samples were constituted by an XC 18 steel plate with a surface area of 30 $cm^2$ and the corrosion tests were carried out at 45° C. with a solution containing water and $NaC_x$, standing for the sodium salt of the $C_6$, $C_7$, $C_8$, $C_{10}$ or $C_{12}$ (diacid) carboxylic acid.

| | |
|---|---|
| table III | 0.10% |
| table IV | 0.25% |
| table V | 0.50% |
| table VI | 0.75% |
| table VII | 1.00% |

The control in each one of these tables only contained water.

TABLE III

| Product | $H_2O$ | $NaC_6$ | $NaC_7$ | $NaC_8$ | $NaC_{10}$ | $Na_2C_{12}$ |
|---|---|---|---|---|---|---|
| | | 48 hours | | | | |
| Loss mg/sample | 15.8 | 17.0 | 1.3 | 15.1 | 14.7 | 10.8 |
| Sample appearance | M + R | M | G | M | M | M |
| Liquid appearance | R | R | C | R | R + T | R |
| Number of tests | 9 | 3 | 3 | 3 | 3 | 3 |
| | | 92 hours | | | | |
| Loss mg/sample | 32.1 | 40.1 | 2.7 | 30.9 | 29.01 | 22 |
| Sample appearance | M + R | M + R | G | M + R | M + R | M |
| Liquid appearance | R | R | C | R | R + T | R |
| Number of tests | 3 | 3 | 3 | 3 | 3 | 3 |

TABLE IV

| Product | $H_2O$ | $NaC_6$ | $NaC_7$ | $NaC_8$ | $NaC_{10}$ | $Na_2C_{12}$ |
|---|---|---|---|---|---|---|
| | | 48 hours | | | | |
| Loss mg/sample | 15.8 | 16.2 | 0.8 | 14.7 | 15.6 | 8.5 |
| Sample appearance | M + R | M | G | M | M | G |
| Liquid appearance | R | R | C | R + T | R | C |
| Number of tests | 9 | 3 | 3 | 3 | 3 | 3 |
| | | 92 hours | | | | |
| Loss mg/sample | 32.1 | 41.2 | 1.65 | 29 | 32.1 | 15.5 |
| Sample appearance | M + R | M + R | G | M | M | M |
| Liquid appearance | R | R | C | R + T | R | R |

TABLE IV-continued

| Product | $H_2O$ | $NaC_6$ | $NaC_7$ | $NaC_8$ | $NaC_{10}$ | $Na_2C_{12}$ |
|---|---|---|---|---|---|---|
| Number of tests | 9 | 3 | 3 | 3 | 3 | 3 |

TABLE V

| Product | $H_2O$ | $NaC_6$ | $NaC_7$ | $NaC_8$ | $NaC_{10}$ | $Na_2C_{12}$ |
|---|---|---|---|---|---|---|
| | | 48 hours | | | | |
| Loss mg/sample | 15.8 | 14.8 | 0.3 | 16.8 | 19.06 | 9.8 |
| Sample appearance | M + R | M | G | M | M | M |
| Liquid appearance | R | R | C | R + T | R | R |
| Number of tests | 9 | 3 | 3 | 3 | 3 | 3 |
| | | 92 hours | | | | |
| Loss mg/sample | 32.1 | 29.1 | 0.55 | 34 | 27.1 | 17 |
| Sample appearance | M + R | M + R | G | M + R | M | M |
| Liquid appearance | R | R | C | R + T | R + T | R |
| Number of tests | 9 | 3 | 3 | 3 | 3 | 3 |

TABLE VI

| Product | $H_2O$ | $NaC_6$ | $NaC_7$ | $NaC_8$ | $NaC_{10}$ | $Na_2C_{12}$ |
|---|---|---|---|---|---|---|
| | | 48 hours | | | | |
| Loss mg/sample | 15.8 | 15.7 | 0.25 | 16.8 | 15.2 | 4.7 |
| Sample appearance | M + R | M | G | M | M | G |
| Liquid appearance | R | R | C | R + T | R | C |
| Number of tests | 9 | 3 | 3 | 3 | 3 | 3 |
| | | 92 hours | | | | |
| Loss mg/sample | 32.1 | 31.2 | 0.48 | 33.7 | 29.7 | 8.2 |
| Sample appearance | M + R | M + R | G | M + R | M | M |
| Liquid appearance | R | R | C | R + T | R + T | R |
| Number of tests | 9 | 3 | 3 | 3 | 3 | 3 |

TABLE VII

| Product | $H_2O$ | $NaC_6$ | $NaC_7$ | $NaC_8$ | $NaC_{10}$ | $Na_2C_{12}$ |
|---|---|---|---|---|---|---|
| | | 48 hours | | | | |
| Loss mg/sample | 15.8 | 16.0 | 0.19 | 16.2 | 14.9 | 3.75 |
| Sample appearance | M + R | M | G | M | M | G |
| Liquid appearance | R | R | C | R + T | R | C |
| Number of tests | 9 | 3 | 3 | 3 | 3 | 3 |
| | | 92 hours | | | | |
| Loss mg/sample | 32.1 | 33.1 | 0.39 | 33 | 27.8 | 7.2 |
| Sample appearance | M + R | M + R | G | M | M | G |
| Liquid appearance | R | R | C | R + T | R | C |
| Number of tests | 9 | 3 | 3 | 3 | 3 | 3 |

EXAMPLE 3

These tests were furthermore supplemented by tests using corrosive water available on an industrial site that was being permanently monitored in order to limit plant corrosion.

The results are given for varying doses, with confirmation of protection for the relevant industrial product, said product being based on $C_7$ carboxylic acid. The results are expressed in the form of corrosion, given in microns per year for the various cases.

TABLE VIII

| PLATES Grade | Bath composition | No. | LENGTH cm | WIDTH cm | AREA $cm^2$ | WEIGHT before g | WEIGHT after g | DURATION days | WEIGHT LOSS $g/m^2/day$ | CORROSION micron/year |
|---|---|---|---|---|---|---|---|---|---|---|
| STEEL XC18 | Control | 0 | 5.38 | 2.53 | 30.1 | 20.5221 | 20.3778 | 2 | 23.970 | 1199 |
| STEEL XC18 | I.W. | 1 | 5.37 | 2.57 | 30.5 | 20.9110 | 20.7617 | 2 | 24.475 | 1224 |
| STEEL XC18 | I.W. + | 2 | 5.42 | 2.67 | 31.9 | 21.8795 | 21.8367 | 2 | 6.708 | 335 |
| STEEL XC18 | 0.5% Sol. T | 3 | 5.44 | 2.68 | 32.2 | 22.2783 | 22.2745 | 2 | 0.590 | 30 |

I.W. = industrial water
Sol. T = aqueous solution containing 140 g/l of heptanoic acid sodium salt and 0.5 g/l sodium benzoate.

TABLE IX

| PLATES Grade | Bath composition | No. | LENGTH cm | WIDTH cm | AREA $cm^2$ | WEIGHT before g | WEIGHT after g | DURATION days | WEIGHT LOSS $g/m^2/day$ | CORROSION micron/year |
|---|---|---|---|---|---|---|---|---|---|---|
| STEEL XC18 | I.W. + | 6 | 5.39 | 2.71 | 32.2 | 22.0644 | 21.9599 | 2 | 16.227 | 811 |
| STEEL XC18 | 0.1% Sol. T | 7 | 5.39 | 2.61 | 31.1 | 21.3279 | 21.2312 | 2 | 15.547 | 777 |
| STEEL XC18 | I.W. + | 4 | 5.40 | 2.56 | 30.6 | 20.9009 | 20.8982 | 2 | 0.441 | 22 |
| STEEL XC18 | 0.5% Sol. T | 5 | 5.39 | 2.50 | 29.9 | 20.1072 | 20.077 | 2 | 5.050 | 253 |

TABLE X

| PLATES Grade | bath composition | No. | LENGTH cm | WIDTH cm | AREA $cm^2$ | WEIGHT before g | WEIGHT after g | DURATION days | WEIGHT LOSS $g/m^2/day$ | CORROSION micron/year |
|---|---|---|---|---|---|---|---|---|---|---|
| STEEL XC18 | I.W. + | 0 | 5.77 | 2.26 | 29.0 | 19.4411 | 19.3635 | 2 | 13.379 | 669 |
| STEEL XC18 | 0.25% Sol. T | 1 | 5.67 | 2.35 | 29.6 | 20.1760 | 20.0635 | 2 | 19.003 | 950 |
| STEEL XC18 | I.W. + | 2 | 5.71 | 2.30 | 29.2 | 19.9395 | 19.937 | 2 | 0.428 | 21 |
| STEEL XC18 | 0.75% Sol. T | 3 | 5.23 | 2.37 | 27.6 | 18.873 | 18.8715 | 2 | 0.272 | 14 |

The industrial water (I.W.) had the following average characteristics:

pH: 7.7

CAT: 7.0° F. (complete alkalimetric titer in degrees F.)

Tsm: 5.8 mg. $1^{-1}$ (total suspended matter)

THT: 14.4° F. (total hydrotimetric titer in degrees F.)

CaHT: 10.2° F. (calcium hydrotimetric titer in degrees F.)

MgHT: 4.2° F. (magnesium hydrotimetric titer in degrees F.)

$Cl^-$: 56.7 mg. $1^{-1}$ total Fe: 0.8 mg. $1^{-1}$ filtered Fe: 0.14 mg. $1^{-1}$ $N\text{-}NH_4$: 0.2 mg. $1^{-1}$ (ammoniacal nitrogen - ammonium ion expressed in mg. $1^{-1}$ of nitrogen).

The results above do establish in a surprising and unexpected manner that heptanoic acid and salts thereof lead to improved effects as regards corrosion inhibition on very numerous metals. Heptanoic acid, apart from the fact that it has no apparent secondary effects, enables the use of multiple compound compositions, which were used up until now, to be avoided, certain of said compounds being able to have undesirable secondary effects for example a complexing action of calcium and, furthermore, they have the advantage of being biodegradable and are hence not dangerous to nature.

EXAMPLE 4

A polarisation resistance (Rp) measurement technique enabled a series of tests to be run for determining corrosion currents at the surface of the metals studied. For copper, currents of 0.1 to 0.2 $\mu A/cm^2$ correspond to normal protection; on the other hand, currents of 2 to 3 $\mu A/cm$ give rise to wear of 25 $\mu$/year, this level being unacceptable. In an unventilated medium, there is not notable corrosion on copper, and the corrosion in aqueous medium manifests itself in ventilated environments.

The use of BZT, benzotriazole, gave the following measurement results for Rp with a 0,1M in $Na_2SO_4$ medium.

| BZT (g/l) | 0.001 | 0.05 | 0.5 | 1.0 |
|---|---|---|---|---|
| Rp ($K\Omega/cm^2$) | 43.0 | 423.0 | 1370.0 | 2300.0 |

The use of sodium heptanoate, as a supplement or as a replacement for other neighbouring sodium salts gave the following results in a ventilated medium using the same Rp measurement technique:

| Ventilation/hour | 2 | 16 | 18 |
|---|---|---|---|
| Progression of Rp | 220 | 461 | 520 |

Activity of the heptanoic acid derivative with copper manifests itself hence for a certain degree of oxidation.

A test on an industrial installation was carried out. The following results were obtained for extended immersion over one month in water with electrolyte.

| Products | $NaClO_4$ 0.1M | | $Na_2SO_4$ 0.1M | | $Na_2B_4O_7$ 0.1M |
|---|---|---|---|---|---|
| BUFFER/ HEPTANOATE | 0 | 0 | 0 | 0.08M | 0.08M |
| APPEARANCE corrosion | | | | | |
| YES | X | X | X | | |
| NO | | | | X | X |

The saline solutions hence attack copper, and the presence of Na heptanoate at a 1% concentration enables all corrosion to be prevented. No surface attack was observed, and the parts stayed perfectly clean after addition of only a small amount of $C_7$ salt.

The stability of the protective layers was also measured by TGA (thermo-gravimetric analysis), and the results demonstrated perfect stability up to 200° C.

Without wishing to be bound to any theory, the applicant believes that what may happen is that, according to the characteristics of the copper metal, the presence of a powerful oxidizing agent generates the metal cation in solution. Following this, the cation forms a stable compound with the anion of the acid form present in the medium, considering the pH of the solution.

The thus-formed salt, which is hydrophobic, then appears to recombine immediately with the original metallic layer. This mechanism is the conceptual equivalent of a known phosphating or chromating treatment for metals, but is less drastic. The manner by which dissolving/combination/re-attachment onto the metal mass takes place is imagined to be via simple adsorption, rather than a mechanism in which protective layers develop by crystalline growth starting from the pure metal.

EXAMPLE 5

The following experiment was carried out using in $C_{10}$, $C_{11}$ et $C_{12}$ acids on zinc:

- sodium undecanoate or dodecanoate was prepared by neutralizing the corresponding acid with soda to a pH of 8;
- this was diluted until the desired concentration for the sodium was obtained (0.005 to 0.05% for $NaC_{10}$ and $NaC_{11}$, 0.005 to 0.01% for $NaC_{12}$);
- the polarisation resistance of a polished zinc electrode was measured using the Stern-Geary method.

The results obtained show that the undecanoate distinguishes itself by a very good level of trade-off between corrosion inhibiting power and aqueous medium solubility.

The polarisation resistance of the zinc in 0.01M $NaC_{11}$ is in fact 1 075 kΩ.cm$^2$, corresponding to a corrosion current of $0.18\times10^{-2}$ μA/cm$^2$, in other words practically zero.

With $Na_2C_{12}$, the results obtained may initially appear to be identical (polarisation resistance Rp better than 1 000 kΩ.cm$^2$ for 0.01M), but the product is at the limit of its solubility and whitish deposits precipitate out which spoil the appearance of the parts.

With $NaC_{10}$ (0.01M), Rp only has a value of 140 kΩ.cm$^2$, which is reflection of the zinc's poor corrosion resistance.

Using these three products again at very low concentrations ($5\times10^{-3}$M), $NaC_{10}$ and $NaC_{12}$ have very mediocre performances (Rp of the order of 10 to 20 kΩ.cm$^2$) whereas there is no substantial variation in the performance of $NaC_{11}$. At higher concentration (0.05M), $NaC_{12}$ precipitates out, the Rp of $NaC_{11}$ is 1 400 kΩ.cm$^2$ and the Rp of $NaC_{10}$ is only 260 kΩ.cm$^2$.

EXAMPLE 6

Carboxylates were prepared under the same conditions as those used in the preceding example. Tests were carried out with the Mg-1Zn-15Al alloy obtained by rapid solidification.

The tests were carried out in ASTM water to which the carboxylate was added, at a pH=8. The results are given in the table below:

| Medium | Duration of immersion | Rp kΩ.cm$^2$ |
|---|---|---|
| ASTM water | 1 h | 5.9 < < 2.0 |
| ASTM water | 2 h | 9.6 < < 6.3 |
| ASTM water + C10 | 1 h | 12.2 to 15 |
| M/50 | 2 h | 17.9 to 24 |
| | 24 h | 27.5 |
| ASTM water + C11 | 1 h | 5.4 to 25.1 |
| M/50 | 2 h | 6.51 to 49.5 |
| | 24 h | 63.2 |
| ASTM water + C12 | 1 h | 2.9 to 5.2 |
| M/50 | 2 h | 7.3 |
| | 24 h | 42 |
| ASTM water + C10 | 1 h | |
| M/100 | 2 h | 30.1 to 37.8 |
| | 24 h | 99.3 |
| ASTM water + C11 | 1 h | 3.7 to 93.8 |
| M/100 | 2 h | 4.6 to 46 |
| | 24 h | 162 |
| ASTM water + C12 | 1 h | 15.7 to 71.4 |
| M/100 | 2 h | 4.61 to 101 |
| | 24 h | 204 |

What is claimed is:

1. A corrosion-inhibiting composition that comprises (a) a monocarboxylic acid selected from the group consisting of heptanoic acid, nonanoic acid, undecanoic acid, and alkali metal and alkaline earth metal salts thereof and (b) a perborate oxidizing agent.

2. The composition of claim 1 wherein said monocarboxylic acid is heptanoic acid.

3. The composition of claim 1 wherein component (a) is a sodium salt.

4. The composition of claim 1 having a pH of about 8.

5. The composition of claim 1 wherein component (b) is present in a concentration of about 0.1M.

6. An aqueous composition that comprises water and from 0.1 to 10% by weight, based upon the weight of said aqueous composition, of a composition according to claim 1.

7. A process of inhibiting corrosion of a metal in an aqueous system that comprises adding to said system a corrosion-inhibiting amount of a composition which comprises (a) a monocarboxylic acid selected from the group consisting of heptanoic acid, nonanoic acid, undecanoic acid, and alkali metal and alkaline earth metal salts thereof and (b) a perborate oxidizing agent.

8. The process of claim 7 wherein said monocarboxylic acid is heptanoic acid.

9. The process of claim 7 wherein component (a) is a sodium salt.

10. The process of claim 7 wherein said composition has a pH of about 8.

11. The process of claim 7 wherein component (b) is present in the composition in a concentration of about 0.1M.

12. The process of claim 7 wherein the composition is added to said aqueous system in a concentration of 0.1 to 10% by weight, based on the weight of said aqueous system.

13. The process of claim 7 wherein the metal is a ferrous metal.

14. The process of claim 7 wherein the metal is a nonferrous; metal.

15. The process of claim 14 wherein the metal is copper.

16. The process of claim 14 wherein the metal is magnesium.

17. The process of claim 14 wherein the metal is zinc.

* * * * *